US005138953A

United States Patent [19]

Horcher et al.

[11] Patent Number: 5,138,953

[45] Date of Patent: Aug. 18, 1992

[54] TRANSPORTATION DEVICE WITH A LOAD CARRIER SUSPENDED MOVABLY FROM A RAIL FOR A SUSPENDED LOAD

[75] Inventors: Willi Horcher; Stefan Horcher, both of Nidderau, Fed. Rep. of Germany

[73] Assignee: Horcher GmbH & Co. KG, Fed. Rep. of Germany

[21] Appl. No.: 639,086

[22] Filed: Jan. 9, 1991

[51] Int. Cl.[5] ..... B66C 17/06

[52] U.S. Cl. ..... 105/149.2; 104/89; 242/74; 212/162

[58] Field of Search ..... 104/89, 94, 93; 105/148, 149.1, 149.2; 414/921; 191/45 A, 2, 6, 12 R, 14, 22 R, 23 R, 23 A, 45 R, 45 A; 238/14.05, 14.11, 14.3; 254/14; 242/74, 74.1; 439/110–120; 212/159, 160, 162, 206, 205, 213, 221

[56] References Cited

U.S. PATENT DOCUMENTS

| | | | |
|---|---|---|---|
| 2,589,803 | 3/1952 | Haley | 104/94 |
| 2,921,146 | 1/1960 | Ericson | 191/45 A |
| 3,780,663 | 12/1973 | Pettit | 105/148 |
| 4,125,908 | 11/1978 | Vail et al. | 104/94 |
| 4,243,147 | 1/1981 | Twitchell et al. | 104/89 |
| 4,252,063 | 2/1981 | Brooks | 104/89 |
| 4,967,976 | 11/1990 | Kawai et al. | 242/74 |

FOREIGN PATENT DOCUMENTS

| | | | |
|---|---|---|---|
| 1092926 | 11/1967 | United Kingdom | 104/89 |

*Primary Examiner*—Robert J. Oberleitner
*Assistant Examiner*—Mark T. Le
*Attorney, Agent, or Firm*—Cushman, Darby & Cushman

[57] ABSTRACT

The object of the invention is a transportation device (1) with a load carrier (3) having on its upper side supports (6) running vertically upwards. Rollers (9, 10) are provided on the ends of the supports, with which the load carrier (3) is attached in suspended and movable fashion from a rail (2). The load carrier contains a winch (72) with a belt (82) for suspended loads. A drive motor (60) is provided to move the load carrier along the rail (2). A further drive motor (63) powers the winch (72). The switches (61, 62) for the drive motors (60, 63) are provided with pneumatically operable switching elements (89). The compressed air for the switching elements is generated by a control element (99) operable by hand that is connected to the load carrier (3) via air lines (98). In the inside of the rail (2) are current paths against which carbon brushes (44, 45) are pressed that are arranged staggered in the longitudinal direction of the rail (2). Energy is supplied to the drive motors (60, 63) via the carbon brushes (44, 45).

9 Claims, 3 Drawing Sheets

Fig. 2.
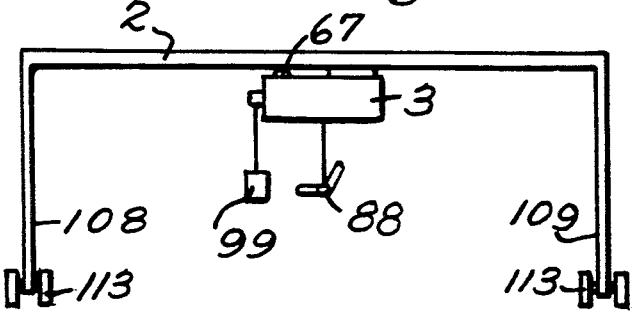
Fig. 3.
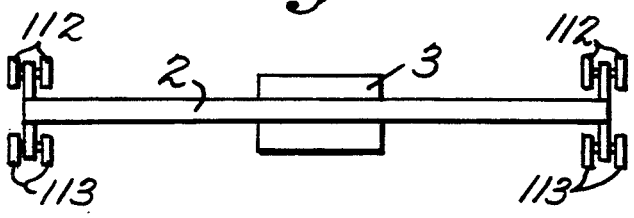
Fig. 4.
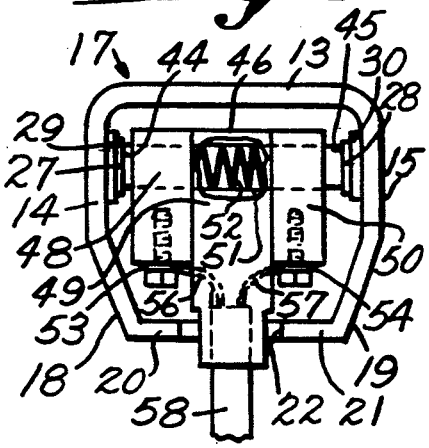
Fig. 5.
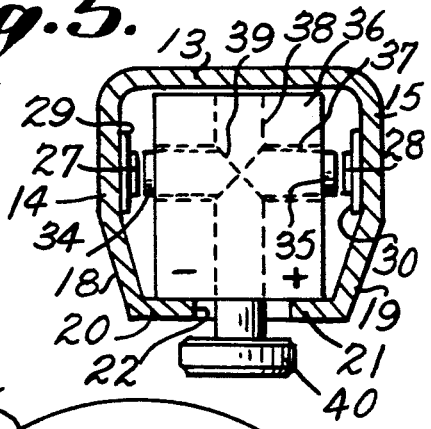
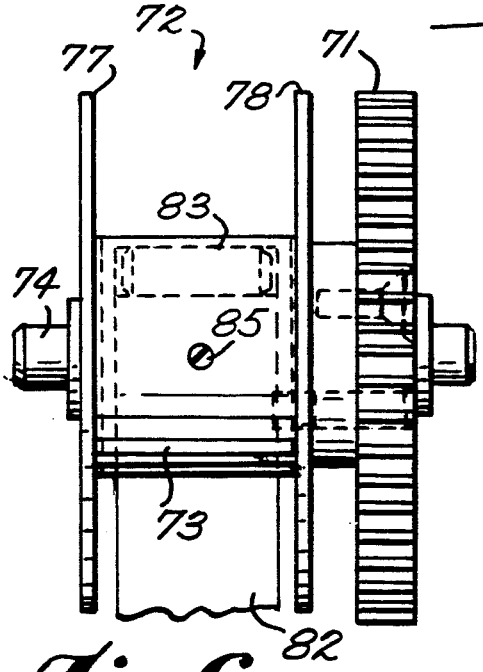
Fig. 6.
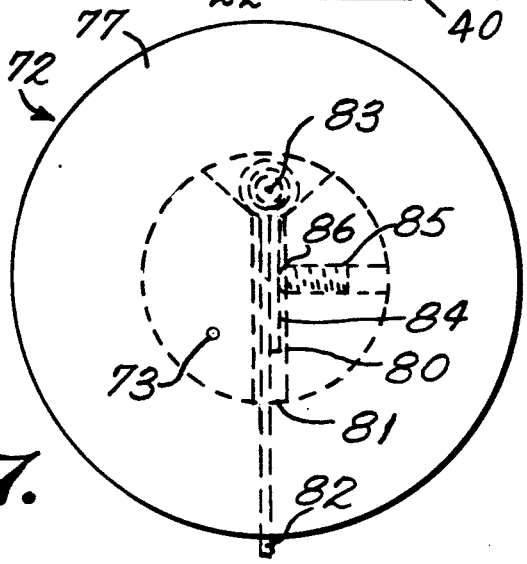
Fig. 7.

TRANSPORTATION DEVICE WITH A LOAD CARRIER SUSPENDED MOVABLY FROM A RAIL FOR A SUSPENDED LOAD

The invention relates to a transportation device with a load carrier having on its upper side supports running vertically upwards on whose ends rollers are provided with which the load carrier is attached in suspended and movable fashion from a rail, said load carrier having a belt for a suspended load, in particular a belt for conveying persons.

BACKGROUND OF THE INVENTION

For persons with insufficient muscle power—for example due to illness—to move themselves over certain distances, load carriers moving along rails provided on the ceilings of rooms in buildings are suitable as transportation means. Patients' seats in particular are suspended by ropes or belts from such load carriers. The rails are run, for example, between a bed and the bathroom/toilet. The load carriers can have a rope winch with a motor-operated drive unit for lifting and lowering the patient seats. The rails can have C-shaped cross-sections.

To transmit the power, bus bars are provided in the rails over which slide carbon brushes fastened to the load carrier and connected to motors, for example for driving the rollers or a rope hoist.

SUMMARY OF THE INVENTION

The object underlying the invention is to further develop a transportation means of the type described at the outset such that control elements for powering the load carrier and a winch can be operated in wet rooms too without danger from voltages, while requiring little space for the current collectors transverse to the longitudinal direction of the rails.

The object is achieved in accordance with the invention in that switches for a drive motor of the load carrier and for a drive motor of a winch are connected by their switching elements to pneumatically operating drive elements connected by at least one flexible air line to a control process having flexible cavities which generate compressed air for switch operation when their volume is reduced by hand, and in that inside the rail, closed in the longitudinal direction except for an underside opening for the supports, both side walls are provided with oblong current paths against which are pressed carbon brushes arranged adjacent to one another by their pressure springs and connection contacts in the longitudinal direction of the rail in a holder fastened to a support.

The control element for the drives contains no circuits. The control element can therefore come into contact with water or be immersed in water without risk. The control element therefore does not have to be treated with great care. Thanks to the staggered arrangement of the brushes in the longitudinal direction of the rails, space is saved in the rail width. The rail dimensions therefore depend mainly on the rollers and the loads to be carried, which determine the wall thickness and height of the rail.

The drive motors are preferably rated for low voltage generated by a transformer feeding the current paths via a rectifier and connectable by its primary side to the AC current mains. The transformer is connected to the ends of the current paths by a cable. The low voltage, in particular of 24 V, ensures additional safety. It is particularly favourable if the low voltage is generated as DC voltage. This permits the provision of batteries in the load carrier that feed the drive units and are charged by the DC voltage. The rectifiers are preferably arranged in a single housing with the transformer, and form with said housing a constructional unit. The load carrier can also operate in the event of a failure in the public power supply mains thanks to the battery buffer feature.

The rail can be designed as a cantilevered beam for the load carrier which is connected at each end to an upright. The uprights are movably mounted on rollers at their lower ends. The rail forms, in conjunction with the uprights, a movable gantry-type transportation device which can be moved inside rooms, for example, to the positions required. The movability of the load carrier along the rail and the movability of the uprights vertical to the rail ensure that the load carrier can reach any point required between the ends of the rail along the movement path of the uprights. The unit is versatile in its application. It can also travel to points where no connection between transformer and mains is possible.

In a preferred embodiment, the load carrier contains a wheel with at least one flexible circumference in contact with the rail, said wheel being connected to one of the drive motors. The connection can be made with a worm gear unit. The driving force is therefore not transmitted to the rail by the rollers, but by the carrier's own wheel. This has the advantage that the rollers can be simply mounted on the vertical supports. Very little space is required for this mounting. The rail does not have to be rated for driving means of the rollers. This means that the rail has to be rated substantially for its guiding and load-bearing functions, which is possible with low dimensions, particularly transverse to the longitudinal axis.

The rail preferably has a profile having a first section comprising a cross-piece with two legs at right angles thereto. The legs are continued in a second section in extensions angled in relation to the centreline of the cross-piece. The ends of the extensions are angled such that they run parallel to one plane of the cross-piece. A free space is available for the supports of the load carrier between the angled ends of the extensions. The current conductors, in particular in the form of copper foils or copper strips, are attached with an intermediate insulator to the insides of the legs at right angles to the cross-piece. The angled extensions ensure that the load carrier rollers guided on the insides of the extension ends cannot reach the current conductors with their circular faces.

The winch comprises a drum with a circular flange at each end. At one point on the circumference of the drum is a depression matching the size of a straight pin. From this depression extends a slot passing through the middle of the drum and having an opening on the circumference of the drum. To fasten a belt from which the patient seat is suspended, one end of the belt is passed around the straight pin. The end projecting beyond the straight pin is inserted into the slot with the belt. The straight pin is then placed in the recess. To fasten the belt to the drum, a bolt is provided which is screwed into a tapped hole at right angles to the slot and which presses with its flat face the belt sections extending from the straight pin against one wall of the slot. In this way, a very simple and secure belt fastening is achieved.

The invention is described in further detail on the basis of a preferred embodiment shown in the drawing, in which further details, features and advantages are apparent.

BRIEF DESCRIPTION OF FIGURES OF DRAWINGS

In the drawings,

FIG. 1 shows a transportation device with a load carrier movably suspended from a rail for suspended loads in longitudinal section, FIG. 2 shows a gantry-type transportation device with a load carrier movably suspended from a rail as a diagram in side view, FIG. 3 shows the gantry-type transportation device shown in FIG. 2 in plane view, FIG. 4 shows a section along the lines I—I of the transportation device shown in FIG. 1, FIG. 5 shows a section along the lines II—II of the transportation device shown in FIG. 2, FIG. 6 shows a winch arranged in the transportation device according to FIG. 1, from the front, FIG. 7 shows the winch as per FIG. 6 in a side view, FIG. 8 shows the load carrier as per FIG. 1, partially in section.

DETAILED DESCRIPTION OF PREFERRED EMBODIMENT

Figure 1:
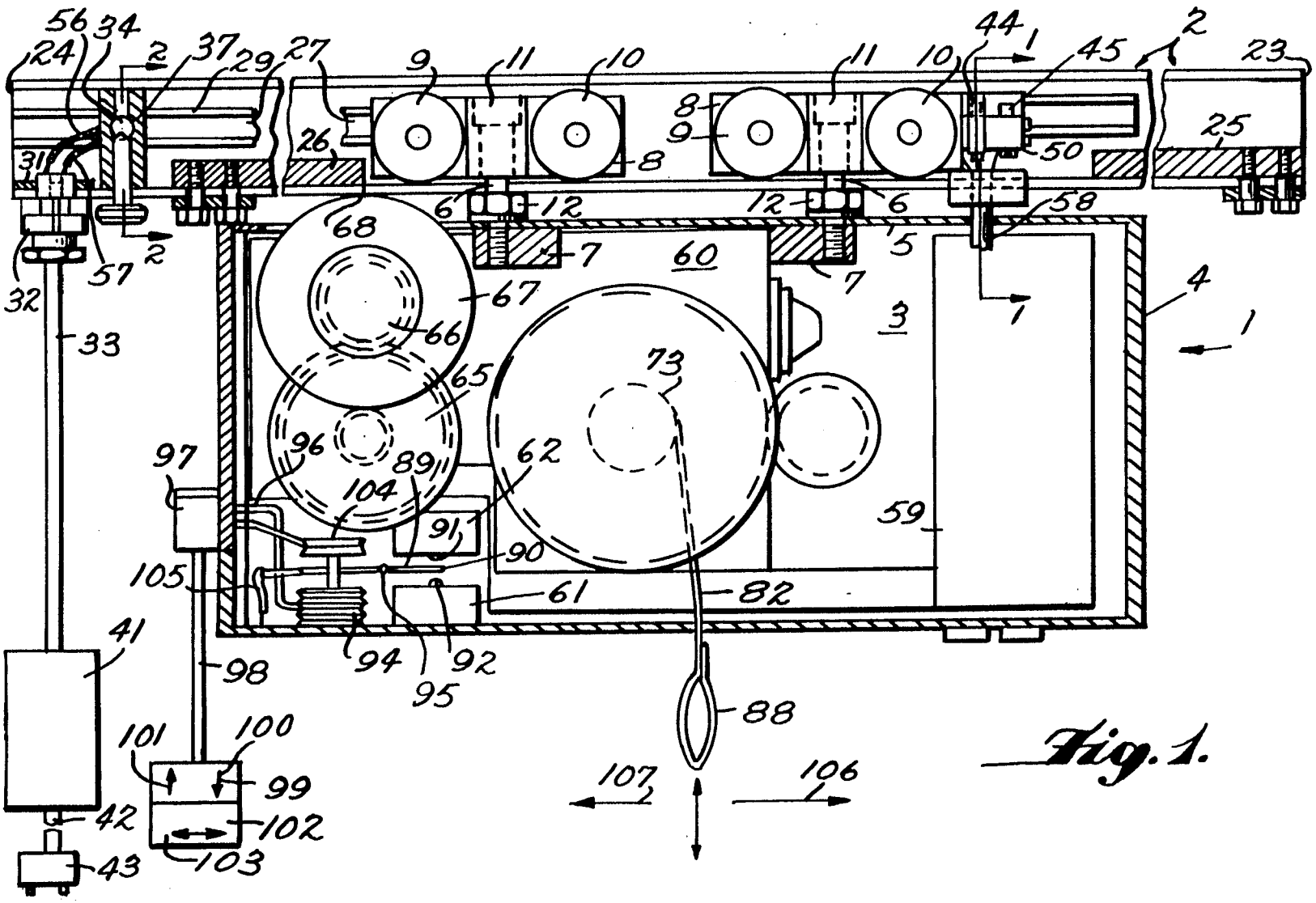
Figure 8:
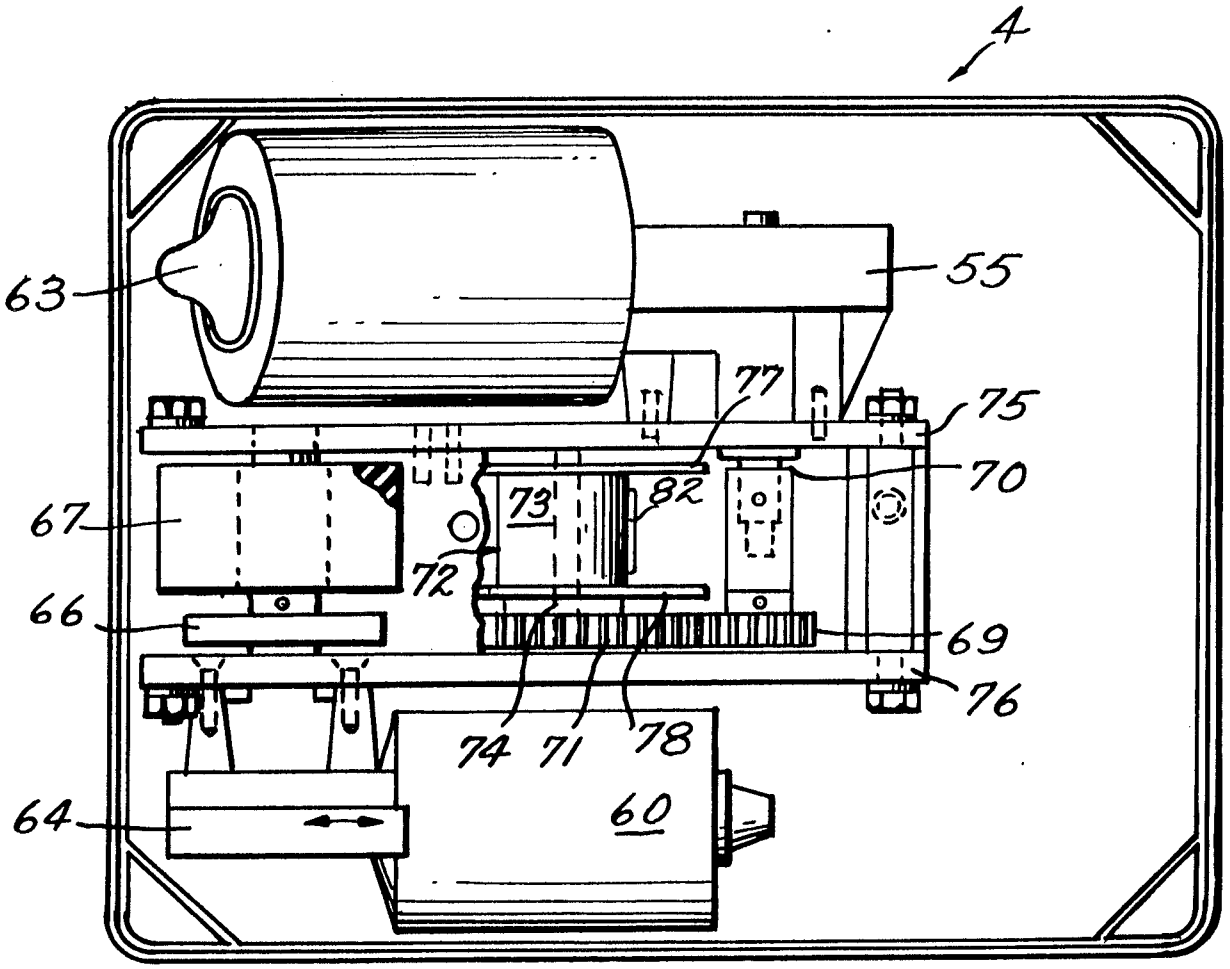

A transportation device (1) for suspended loads contains at least one rail (2) to which a load carrier (3) is attached in suspended fashion. The load carrier (3) is movable along the rail (2) and has a box-like housing (4). Two supports (6) are attached to the upper side (5) of the box-like housing (4) and extend vertically upwards from the upper side (5). The supports (6) have in particular the form of countersunk bolts whose ends are screwed into reinforcing plates (7) attached to the inner wall of the upper side (5). The supports pass through holes—not shown in detail—in holding plates (8) in which two pairs of rollers (9, 10) are rotatably mounted in each case. The roller pairs are arranged in each holding plate (8) at a distance from one another on either side of the holes for the supports (6). The holes have at their ends facing away from the housing (4) extended sections into which the countersunk bolt heads (11) are inserted. Lock nuts (12) are provided for rigid attachment of the supports (6) to the housing (4), screwed onto the ends of the supports (6) and resting on shims—not shown in detail—on the upper side.

The rollers (9, 10) project beyond the upper side and the lower side of the holding plates.

The rail (2) has a profile having a horizontal cross-piece (13) and two legs (14, 15) at right angles thereto. This part of the profile can be regarded as a section. The legs (14, 15) are continued in a further section in extensions (18, 19) inclined in relation to the centreline of the cross-piece and having angled ends (20, 21). The ends (20, 21) are angled such that they run parallel to the cross-piece (13). A free space (22) is provided between the ends (20, 21) for the supports (6) to pass through.

The rollers (9, 10), the holding plates with the countersunk bolt heads (11) and the parts of the support (6) that extend from the countersunk bolt heads (11) are inside the rail (2). The rollers (9, 10) rest on the ends (20, 21).

Inside the rail (2), stops (25, 26) are attached on or near to the two faces (23, 24) on the insides of the ends (20, 21), i.e. the running surfaces for the rollers (9, 10). These stops prevent the rollers (9, 10) from leaving the rail (2).

Bus bars in the form of copper strips (27, 28) or copper foils on top of insulating layers (29, 30) are fastened to the insides of each leg (14, 15). Between the face (23) and the stop (26) is an insert (31) connected to the insides of the ends (20, 21) and having a tapped hole—not shown in detail—into which a screw union (32) is inserted for the end of a cable (33). The conductors—not shown in detail—of the cable (33) are connected in the rail (2) to contact pins (34, 35) that are movably arranged in an insulating element (36) fastened inside the rail (2) in a hole (37) provided at the level of the copper strips (27, 28). Each contact pin (34, 35) extends predominantly in one half of the hole (37). A tapped hole (38) crosses the hole (37) in the middle of the insulating element (36). The contact pins (34, 35) have in the interior of the hole (37) conical ends (39). A bolt can be screwed into the tapped hole (38) from opening (22) and has a conical end—not shown in detail—that is pressed against the ends (39). Here, the contact pins (34, 35) are pushed a short way out of the insulating elements (36) and each make contact at their other blunt ends—not shown in detail—with the copper strips (27, 28). As a result, an electrically conductive connection is achieved between the conductors of the cable (33) and the copper strips (27, 28).

The other ends of the conductors of the cable (33) are connected in a housing (41) to a rectifier—not shown in detail—fed by a transformer whose primary winding can be connected to the public mains using a cable (42) and plug (43).

With the transformer and the rectifier, a low voltage of 24 V in particular is generated from the mains AC voltage and can be tapped at the copper strips (27, 28).

To tap the DC voltage at the copper strips (27, 28), carbon brushes (44, 45) are provided in a staggered arrangement in recesses of a holder (46) in the longitudinal direction of the rail (2). The holder (46) comprises, for example, three interconnected segments (48, 49, 50) in which are arranged the recesses (51) of which only one is visible in FIG. 4. The carbon brushes (44, 45) are connected with pressure springs (52) whose pretension presses the carbon brushes against the copper strips (27, 28). The pressure springs (52) here rest on angled plates (53, 54) covering one side of the recesses (51). Conductors (56, 57) of a cable (58) whose end is held by the centre segment (50) run from the conductive angled plates (53, 54) into the housing (4). The staggered arrangement of the carbon brushes (45, 46) in the longitudinal direction of the rail (2) saves space in the width direction of the rail (2), so that the latter can have a low width.

The angled extensions (18, 19) of the rail (2) ensure that the faces of the rollers (9, 10) cannot move right up to the copper strips (27, 28).

In the housing (4), a dry battery (59) is connected to the conductors (56, 57). Furthermore, a drive motor (60) is connected via switches (61, 62) to the conductors (56, 57). An additional drive motor (63) is connected to the conductors (56, 57) via switches—not shown—arranged next to the switches (61, 62). The drive motors (60, 63) are DC motors. The drive motor (60) is connected to a worm gear unit (64) containing an output-side gear (65) meshing with a gear (66) seated on a shaft with a rubber wheel (67). The rubber wheel (67) rotatably mounted in the housing (4) is pressed at one point (68) on its circumference against the underside of the rail (2) and transmits a driving force from the housing (4) to the rail (2). Depending on the rotation direction of the rubber wheel (67), the load carrier (3) moves forwards or backwards along the rail (2). The rotation direction of the drive motor is determined by the setting of the switches (61, 62) operated by setting elements described in detail below. The worm gear unit (64) self-locks to prevent the load carrier (3) moving along the rail (2) when the drive motor (60) is switched off.

The drive motor (63) attached inside the housing (4) is connected to a worm gear unit (55) having on its output side a gear (69) seated on an arbor (70). The gear (69) meshes in a gear (71) associated with a winch (72). The winch (72) contains a drum (73) arranged on an arbor (74) common to the gear (71). The arbor (74) is rotatably mounted in the housing (4) between parallel plates (75, 76).

The drum (73) contains at each end a circular flange (77, 78). At one point on the circumference of the drum (73) a depression (79) is provided. A slot (80) passing through the middle of the drum (73) and having an opening (81) diametrically opposite to the depression (79) starts at the lower end of the depression (79). The width of the depression (79) and the width of the slot (80) is matched to the width of a belt (82), to one end of which a load is attached. The other end of the belt (82) is passed around a straight pin (83) inserted into the depression (79) with the appropriate end of the belt (82). The depression (79) is matched to the radial expansion of the straight pin (83) including the diameter increase resulting from the belt section wound around the straight pin (83), such that the straight pin (83) or the belt section surrounding it do not project beyond the limit set by the drum diameter.

The belt (82) projects with its end (84) inside the slot (80) beyond the centre of the drum (73). A tapped hole (85) in the radial direction is provided in the drum (73) and extends to the slot (80). A bolt (86) is inserted into the tapped hole (85), and its flat face is pressed against the end (84) and the bolt (86) itself presses the belt (82) against one wall of the slot. In this way, the belt end is firmly connected to the drum (73). At the other end of the belt (82), a patient seat (87) is attached and is suspended in a loop (88) at the end of the belt.

When the drum (73) rotates, the belt (82) is wound or unwound depending on the direction of rotation. The load or the patient seat (87) without or without load is then raised or lowered. The self-locking feature of the worm gear unit (55) has the effect that the patient seat (87) is not lowered when subjected to a load and while the drive motor (63) is switched off.

In the housing (4), a switching element (89) in the form of a swivel lever is provided for the switches (61, 62), one arm (90) of this lever being pressable against projections (91, 92) depending on the rotary position of the switching element (89). The other lever arm is connected via a pin (95) to a closing plate—not shown in detail—of a pneumatic bellows (94).

The pneumatic bellows (94) is the drive element for the lever arm (93).

The bellows (94) is connected to a flexible air line (96), which is connected, via a connection piece (97) fastened to the housing (4), to a flexible air line (98) hanging down from the connection piece (97).

A control element (99) is attached to the lower end of the air line (98) and is also designed flexible. The control element (99) has several sections (100, 101, 102, 103) associated with various functions. The section (101) has an air-filled cavity—not shown—that can be compressed by hand and that is connected to a bellows, for example bellows (94), by a duct in the air line (98). When the cavity is compressed, a compressed air wave is generated that causes a volume change in the bellows (94) which generates a mechanical movement of the switching element (89). Here, the lever arm (90) presses against the projection (92), for example, whereby the switch (61) is operated that connects the drive motor (63) to the copper strips (27, 28) such that the winch (72) winds on the belt (82), i.e. the loop (88), possibly with attached patient seat (87) including a patient, is moved upwards. The section (100) of the control element (99) also has an air-filled cavity—not shown—that can be compressed by hand and that is connected to a bellows in the housing (4) by a duct in the air line (98) and by a line. This bellows, numbered (104), operates the switching element (89), the lever arm being pressed against the projection (91) of the switch (62). When the switch (61) is operated, a voltage is applied to the drive motor (63) that adjusts the rotation direction of the drive motor (63) such that the belt (82) with the loop (88) and the patient seat (87) is moved downwards. The switching element (89) is kept in its centre position, in which neither switch (61, 62) is operated, by a spring (105), so that the drive motor (63) is without voltage.

Two switches are provided for the drive motor (60) and for the drive motor (63), but are not shown in detail. The switches contain, like switches (61, 62), projections against which a switching element can be pressed that is similar to switching element (89) and is likewise operable by two bellows that can be supplied with compressed air by one of the two sections (102, 103). The sections (102, 103) have air-filled cavities that can be compressed by hand and that are connected to one of the bellows by one duct each. When the section (102) is operated by compression of the cavity, the drive motor (60) is applied to the DC voltage such that it drives the rubber wheel (67). As a result the load carrier (3) is moved in a direction shown by an arrow (106) in FIG. 1 and corresponding to a rearward motion, for example. Operation of the section (103) has the effect of applying the drive motor (60) to voltage in the opposite direction, so that the rubber wheel (67) turns in the opposite direction, shown by the arrow (107) in FIG. 1 and corresponding to forward motion.

The control element (99) has no parts conducting voltage or current, and can therefore come into contact with moisture or liquid without any risk to the operator.

In a useful embodiment, the rail (2) is connected at its ends to uprights (108, 109) of which the lower ends rest on holders (110, 111) respectively, arranged horizontally and having at their ends rotatably mounted pairs of rollers (112, 113). The entire transportation device can be moved on these rollers (112, 113). It is therefore possible to select any point to pick up or set down patients using the belt (82) and the loop (87) or patient seat (87) within a range reachable by movement of the "gantry-type transportation device".

We claim:

1. A transportation device for patients and others needing to be suspended while being moved, comprising:

a vertically-suspended load carrier support means extending vertically from said load carrier to support the load carrier in suspension, rollers, means mounting said rollers at the upper end of said support means, enclosed horizontally-extending rail means including horizontally-extending rails, having a downwardly-open slot receiving said support means and supporting said rollers for horizontal motion along said rails, means closing the ends of said horizontally-extending rail means, a power winch in said load carrier and including a low voltage winch motor, a belt connected to said winch for a suspended load, a low voltage roller drive motor for moving said rollers along said rails, switching means for said roller drive motor and said winch motor, said switching means including switching elements, pneumatically operable drive elements operatively connected to said switching elements to actuate the switching elements, a control element having flexible cavities, at least one flexible air line connecting said flexible cavities to said pneumatically operable drive elements, whereby squeezing said control element causes actuation of said switching elements, elongated current paths comprising copper elements inside and extending along said rail means, a carbon brush holder and carbon brushes arranged adjacent to one another in the longitudinal direction of said rail means attached to said carbon brush holder, pressure springs and connection contacts pressing said carbon brushes against said current paths, a transformer, including means for connection to a source of AC power, a rectifier connected to said transformer and supplying DC electric power to said current paths, an insulating element, contact pins and a bolt adjustably arranging said contact pins in said insulating element, said contact pins being pressed against said current paths near to one face of said rail, a cable connected to said contact pins and receiving electric power from said rectifier.

2. A transportation device as set forth in claim 1 wherein said rail for said load carrier is a cantilevered beam connected at each end to an upright.

3. A transportation device as set forth in claim 2 including rollers and means mounting said rollers at the lower ends of said uprights, whereby said transportation device can be moved to a location where it is to be used.

4. A transportation device as set forth in claim 1 including a wheel having a flexible circumference, means operatively connecting said wheel to said load carrier and in contact with the lower surface of said rail means, and means operatively connecting said wheel to one of said motors.

5. A transportation device as set forth in claim 4 in which said means operatively connecting said wheel to one of said motors includes a worm gear unit.

6. A transportation device as set forth in claim 1 in which said rail means, in cross-section, has a first section comprising a cross-piece, two depending legs extending at right angles from the respective ends of said cross-piece, first extensions depending from said legs and inclined towards each other, and second extensions, extending parallel to said cross-piece and towards each other from the distal ends of said first extensions, said second extensions being spaced from each other to provide said downwardly-open slot.

7. A transportation device as set forth in claim 1 including a battery in a housing of said load carrier and connected to said current paths.

8. A transportation device as set forth in claim 1 in which said winch has a drum at one point of whose circumference there is a depression, a straight pin in said depression, a belt around said pin, the center of said drum having a slot which extends from said depression and which extends to an opening in said drum diametrically opposite from said depression, a portion of said belt and one end of said belt projecting beyond said straight pin and being parallel to each other in said slot, and said one end of said belt being clamped by a bolt.

9. A transportation device for patients and others needing to be suspended while being moved, comprising:

a vertically-suspended load carrier support means extending vertically from said load carrier to support the load carrier in suspension, rollers, means mounting said rollers at the upper end of said support means, enclosed horizontally-extending rail means including horizontally-extending rails, having a downwardly-open slot receiving said support means and supporting said rollers for horizontal motion along said rails, means closing the ends of said horizontally-extending rail means, said rail means, in cross-section, having a first section comprising a cross-piece, two depending legs extending at right angles from the respective ends of said cross-piece, first extensions depending from said legs and inclined towards each other, and second extensions, extending parallel to said cross-piece and towards each other from distal ends of said first extensions, said second extensions being spaced from each other to provide said downwardly-open slot, a power winch in said load carrier and including a low voltage winch motor, a belt connected to said winch for a suspended load, a low voltage roller drive motor for moving said rollers along said rails, switching means for said roller drive motor and said winch motor, said switching means including switching elements, pneumatically operable drive elements operatively connected to said switching elements to actuate the switching elements, a control element having flexible cavities, at least one flexible air line connecting said flexible cavities to said pneumatically operable drive elements, whereby squeezing said control element causes actuation of said switching elements, elongated current paths comprising copper elements per strips inside and extending along said rail means, a carbon brush holder and carbon brushes arranged adjacent to one another in the longitudinal direction of said rail means attached to said carbon brush holder, pressure springs and connection contacts pressing said carbon brushes against said current paths, a wheel having a flexible circumference, means operatively connecting said wheel to said load carrier and in contact with the lower surface of said rail means, and worm gear means operatively connecting said wheel to one of said motors.

* * * * *